United States Patent [19]

Kubota et al.

[11] Patent Number: 4,481,270

[45] Date of Patent: Nov. 6, 1984

[54] PHOTORECEPTOR CONTAINING SQUARIC ACID METHINE DYES

[75] Inventors: Tomio Kubota, San Jose; Herbert K. Wurster, Los Gatos, both of Calif.

[73] Assignee: Ricoh Systems, Inc., San Jose, Calif.

[21] Appl. No.: 489,405

[22] Filed: Apr. 28, 1983

[51] Int. Cl.[3] ..... G03C 5/06

[52] U.S. Cl. ..... 430/55; 430/58; 430/72; 430/74; 430/77; 430/78; 430/83

[58] Field of Search ..... 430/58, 55, 73, 74, 430/76, 77, 78, 83

[56] References Cited

U.S. PATENT DOCUMENTS

| | | | |
|---|---|---|---|
| 3,140,182 | 7/1964 | Heseltine et al. . | |
| 3,647,427 | 3/1972 | Hanada et al. . | |
| 3,681,067 | 8/1972 | Hanada . | |
| 3,816,118 | 6/1974 | Byrne . | |
| 3,824,099 | 7/1974 | Champ et al. | 430/58 |
| 4,071,361 | 1/1978 | Marushima | 430/55 |
| 4,123,269 | 10/1978 | Von Hoene et al. . | |
| 4,275,132 | 6/1981 | Chu et al. . | |
| 4,353,971 | 10/1982 | Chang et al. . | |

FOREIGN PATENT DOCUMENTS

| | | | |
|---|---|---|---|
| 4049134 | 11/1967 | Japan . | |
| 57-144558 | 2/1981 | Japan . | |
| 1337228 | 2/1971 | United Kingdom | 430/58 |

OTHER PUBLICATIONS

Merritt, *IBM J. Res. Develop.*, vol. 22, No. 4, p. 353 (Jul. 1978), "Organic Photovoltaic Materials: Squarylium and Cyanine-TCNQ Dyes".

Jipson, et al., *J. Vac. Sci. Technol.*, vol. 18, No. 1, p. 105 (Jan./Feb. 1981), "Infrared Dyes for Optical Storage".

Loutfy, et al., *Photographic Science and Engineering*, vol. 27, No. 1, p. 5, (Jan./Feb. 1983), "Photoconductivity of Organic Particle Dispersions: Squaraine Dyes".

Balanson, et al., *IBM Technical Disclosure Bulletin*, vol. 24, No. 11B, p. 6194 (Apr. 1982), "Reduction of Fatigue in Squarylium Particulate Photoconductor by Electron-Transport Doping".

*Primary Examiner*—John E. Kittle
*Assistant Examiner*—John L. Goodrow
*Attorney, Agent, or Firm*—Flehr, Hohbach, Test, Albritton & Herbert

[57] ABSTRACT

An electrophotographic imaging process having a double charging sequence and a photoreceptor utilized therein are provided, wherein the photoreceptor comprises a substrate, a photosensitive layer comprising a squaric acid methine dye, and an insulating layer. The photosensitive layer may also comprise a squaric acid methine dye and a charge transport material.

11 Claims, No Drawings

PHOTORECEPTOR CONTAINING SQUARIC ACID METHINE DYES

The present invention is directed to a photoreceptor for an electrophotographic imaging process having a double charging sequence. Specifically, the photoreceptor is panchromatic and responsive to infrared light.

The formation and development of images on the imaging surfaces of photoconductive materials by electrostatic means is well-known. The best known of the commercial processes is commonly known as xerography, which involves forming an electrostatic latent image on the imaging surface of the imaging member by first uniformly electrostaticly charging the surface of the imaging layer in the dark and exposing this electrostaticly charged surface to an image-wise pattern of activating electromagnetic radiation. The light-struck areas of the imaging layer are thus rendered relatively conductive and the electrostatic charge is selectively dissipated in these irradiated areas. After the photoconductor is exposed, the electrostatic laden image is typically rendered visible with a finely divided color marking material known in the art as toner.

Electrophotographic imaging processes having double charging sequences are also known. U.S. Pat. No. 3,676,117 discloses a process comprising the steps of applying a first field of one polarity across a photosensitive element including a photoconductive layer and a highly insulating layer integrally bonded to one side of the photoconductive layer. Then, applying a second field including a component of polarity opposite to the polarity of the first field, across the photosensitive element. Finally, projecting a light image on the photosensitive element from the side of the highly insulative layer concurrently with, or after application of the second field to form an electrostatic latent image corresponding to the light image on the surface of the highly insulative layer. The process is characterized by the step of projecting uniform light on the side of the photosensitive element opposite the insulative layer concurrently with or prior to or subsequent to the application of the first field.

Another known electrophotographic process having a double charging sequence, commonly referred to as the Canon process, comprises the steps of uniformly charging positively or negatively the insulative layer of a photosensitive plate, exposing the charged insulative layer surface simultaneously to projection of an original picture image and to a second charge thereby forming an electrostatic picture image of the original image on the insulative layer surface, and subsequently exposing the entire surface of the insulative layer uniformly to light thereby causing a highly contrasted electrostatic image to be formed on the insulative layer surface.

Various types of photoreceptors are known for use in electrophotographic imaging processes having double charging sequences. For example, U.S. Pat. No. 4,251,612 discloses a photoreceptor comprising a substrate, a layer of a charge carrier injecting material comprised of carbon or graphite dispersed in a polymer, a layer of a charge carrier transport material, a layer of a photoconductive charge carrier generating material, and an electrically insulating overcoating layer. U.S. Pat. No. 4,254,199 discloses a photoreceptor comprising a substrate, a layer of charge carrier injecting material, such as gold, graphite, aluminum, or indium, a layer of charge carrier transport material, a layer of photoconductive charge carrier generating material and a layer of electrically insulating polymeric material.

A double charging sequence is also utilized in the electrostatographic process of making color copies. In U.S. Pat. No. 4,250,239 there is disclosed a color electrostatographic process with two photoconductive layers of different spectral sensitivity. The photoconductive layer is charged the first time in the dark rendering one of the layers conductive and a second time with opposite polarity in the dark to form a stratified electrostatic charged pattern. Exposure to a light image of an original document causes the layers to conduct according to color. The toner particles of two colors, such as red and black, adhere to respective areas of the resulting electrostatic image which have opposite polarities. Transfer of the resulting toner image to a copy sheet produces a finished image in two colors. The photoreceptor has two photoconductive layers, one which is sensitive to first and second colors and the other which is sensitive to only the second color, or one layer which is sensitive to one color and the other layer sensitive to the other color.

U.S. Pat. No. 3,617,270 discloses the use of squaric acid methine dyes for the optical sensitization of zinc oxide. U.S. Pat. Nos. 3,824,099, 3,837,851, 4,123,270, and 4,150,987 disclose the use of squaric acid methine dyes for a conventional charge generation layer with a P-type charge transport layer in a layered electrophotographic plate. Squaric acid methine dyes have been disclosed as useful in electrophoretic migration imaging process in U.S. Pat. No. 4,175,956.

As the art of electrophotography advances, more stringent demands are imposed upon the copying apparatus because of increased performance standards, thus, the need for an improved photoreceptor is always present. It is therefore an object of the present invention to provide novel and improved photoreceptors for use in an electrophotographic imaging process having a double charging sequence, comprising a photosensitive layer of squaric acid methine dyes.

The word processing and data processing industries which utilize electronic printers are also a source of continuing improvements and more stringent demands. One aspect of electronic printing is the development of laser diodes which emit light at approximately 800 nm. However, before such laser diodes may be utilized on a commercial scale, new photoreceptors sensitive in the infrared region of the spectrum must be produced. Thus, another object of the invention is to provide an improved photoreceptor sensitive in the infrared region of the spectrum.

Another object of the invention is to provide an improved photoreceptor for use in the color electrostatographic process.

The present invention is directed to a photoreceptor for electrophotographic imaging processes having a double charging sequence, comprising: a substrate, a photosensitive layer comprising a squaric acid methine dye selected from the group consisting of compounds of the formula I:

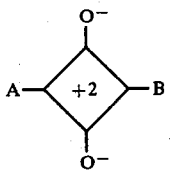

(I)

wherein A and B are independently,

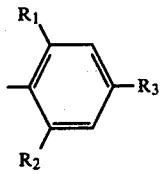

wherein $R_1$, $R_2$, and $R_3$, are independently H, OH, alkyl of 1 to 6 carbon atoms, or $NR_4R_5$, wherein $R_4$ and $R_5$ are independently alkyl of 1 to 6 carbon atoms;

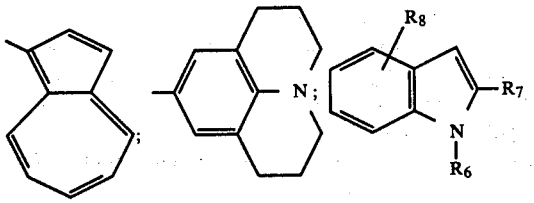

wherein $R_6$ and $R_7$ are independently alkyl of 1 to 6 carbon atoms, and $R_8$ is independently H, $OR_9$ or halogen, wherein $R_9$ is alkyl of 1 to 6 carbon atoms;

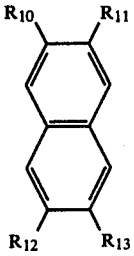

wherein $R_{10}$, $R_{11}$, $R_{12}$ and $R_{13}$ are independently H, OH or alkyl of 1 to 6 carbon atoms;

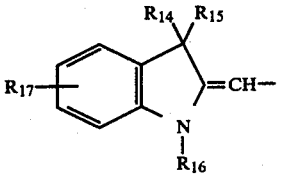

wherein $R_{14}$, $R_{15}$, and $R_{16}$ are independently alkyl of 1 to 6 carbon atoms, and $R_{17}$ is independently H, $OR_{18}$, or halogen, wherein $R_{18}$ is alkyl of 1 to 6 carbon atoms; or

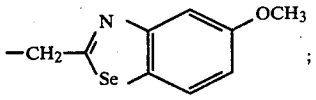

and an insulating layer.

General methods for the preparation of squaric acid methine dyes are known and are disclosed in, for example, Treibs et al., *Angew. Chem. Internat. Ed.* 4, 695 (1965); Sprenger et al., *Angew. Chem. Internat. Ed.* 5, 894 (1966); and Treibs et al., *Leibig's Ann. Chem.*, 712, 123 (1968). Generally, squaric acid is reacted with the desired carbocyclic or heterocyclic compound in a suitable solvent with heating. The product is isolated by cooling the reaction mixture to obtain crystals or by adding thereto a non-solvent for the dye.

A preferred class of squaric acid methine dyes are those according to the formula I wherein A and B are independently substituted or unsubstituted phenyl as set forth above. A particularly preferred squaric acid methine dye is that wherein A and B are independently

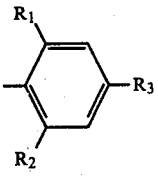

wherein $R_1$ is methyl, $R_2$ is hydrogen, and $R_3$ is dimethylamino.

The particle sizes of the squaric acid methine dyes are preferably in the range of about 2 to 30 millimicrons in diameter. The particular particle size distribution may depend upon the reprecipitation process, milling time and solvents used to prepare the dye. Generally, with decrease of particle size, the charge acceptance and sensitivity of the photoreceptor increases while the residual and dark decay is decreased. The spectral response of the photoreceptor of the invention is from about 400 to 900 nm.

The solvent which is used to prepare the squaric acid methine dye is selected on the basis of polymer-binder solubility and volatility. Solvents which may be utilized to prepare the dye include ethers, cyclic ethers, halogenated hydrocarbons, ketones, aliphatic solvents, and aromatic solvents. A preferred class of solvents comprises tetrahydrofuran, chloroform, methylene chloride, carbon tetrachloride, acetone, benzene and toluene. Tetrahydrofuran and methylene chloride are particularly preferred solvents because of excellent dispersive characteristics and high volatility. Variation in solvent or solvent mixtures may be used to alter the electrical properties of the coatings due to variation in polarities and drying times.

The photosensitive layer of squaric acid methine dye according to the present invention can be prepared as a suspension of squaric acid methine dye in a solution of an appropriate binder. The binder may be selected from a variety of polymers, for example, Epoxy-Epon 1007 F (a 4,4'-isopropylidene diphenolepichlorohydrin resin manufactured by Shell Chemical Co.), Acryloid-B66 (a methyl/butyl methacrylate copolymer manufactured by Rohm and Haas Co.), Vylon-200 (a polyester resin manufactured by Toyob Co., Japan), Panlite L-1250 and K1300 (a polycarbonate resin manufactured by Teijin Co., Japan), polyurethane, polystyrene, and Luvican (a polyvinylcarbazole manufactured by BASF).

The dye to binder ratio in the photosensitive layer may be in the range from about 1:1 to 1:40. Preferably, the dye to binder ratio should be in the range of from about 1:2 to 1:10, most preferably at 1:6. Concentration of the dye-binder suspension may be adjusted to viscosities which insure suitable coating characteristics. For example, generally in dye-binder ratios varying from 1:3 to 1:10, the solvent concentrations used to prepare the slurries vary from approximately 90% to 78%, respectively.

The electrophotographic characteristics of the photoreceptor according to the present invention are particularly advantageous if the photosensitive layer of squaric acid methine dye includes a charge transport material. The charge transport material may contain organic charge transport materials, such as triphenylamine (TPA), isopropylcarbazole, methylphenylhydrazono-3-methylidene-9-ethylcarbazole, 1-phenyl-3-(4-diethylaminostyryl)-5-(4-diethylaminophenyl)-2-pyrazoline, triphenylmethane, triphenylene, pyrene and perylene, or inorganic photoconductive materials, such as selenium or selenium alloys. A preferred organic charge transport material is triphenylamine and a preferred inorganic photoconductive material is selenium.

The photosensitive layer of squaric acid methine dye with a charge transport material may be in a single layer or in two or more layers. If the photosensitive layer has two or more layers, at least one layer is squaric acid methine dye and at least one layer is a charge transport layer of either an organic charge transport material or an inorganic photoconductive material. The charge transport layer may be either above the squaric acid methine dye layer or underneath the squaric acid methine dye layer. In either case, the insulating layer is on the top of the photoreceptor and the substrate is on the bottom.

Insulating materials for the insulating layer of the present invention can be selected from the group of polyester, polycarbonate, polyacetate, polystyrene, polyfluoroethylene, polyethylene, polypropylene, polyvinyl chloride, polyvinylidene chloride, polyurethane, epoxy resin and melamine resin.

Preferably, the insulating layer is comprised of polyester. The substrate may be comprised of aluminum or any conductive metal, or a plastic such as a polyester which has a conductive coating.

The present invention contemplates an electrophotographic imaging process having a double charging sequence, utilizing a photoreceptor with a photosensitive layer of squaric acid methine dye as described hereinabove. The process involves charging a photoreceptor the first time with electrostatic charges of one polarity, charging the photoreceptor a second time with electrostatic charges of a polarity opposite to the first polarity, or with A.C. electrostatic charges, and simultaneously exposing the photoreceptor to an image-wise pattern of activating electromagnetic radiation. Then the photoreceptor is exposed to a uniform amount of activating electromagnetic radiation to form an electrostatic latent image which conforms to the image-wise pattern of the original.

Exemplary squaric acid methine dyes useful according to the present invention include, but are not limited to, the following:

(1) 2,4-bis-(2-methyl-4-dimethylaminophenyl)-1,3-cyclobutadienediylium-1,3-diolate
(2) 2,4-bis-(p-dimethylaminophenyl)-1,3-cyclobutadienediylium-1,3-diolate
(3) 2,4-bis-(2,4,6-trihydroxyphenyl)-1,3-cyclobutadienediylium-1,3-diolate
(4) 2,4-bis-(2-hydroxy-4-dimethylaminophenyl)-1,3-cyclobutadienediylium-1,3-diolate
(5) 2,4-bis-(1-azulenyl)-1,3-cyclobutadienediylium-1,3-diolate
(6) 2,4-bis-(p-jujolidenyl)-1,3-cyclobutadienediylium-1,3-diolate
(7) 2,4-bis-(2-hydroxy-4-diethylaminophenyl)-1,3-cyclobutadienediylium-1,3-diolate
(8) 2,4-bis-(1,2-dimethylindolenyl-3-)1,3-cyclobutadienediylium-1,3-diolate
(9) 2,4-bis-(2,3-dihydroxynaphthyl)-1,3-cyclobutadienediylium-1,3-diolate
(10) 2-(4-dimethylaminophenyl)-4-(2-methyl-4-dimethylaminophenyl)-1,3-cyclobutadienediylium-1,3-diolate
(11) 2,4-bis-(2-methyl-4-diethylaminophenyl)-1,3-cyclobutadienediylium-1,3-diolate
(12) 2,4-bis-(2-methyl-5-chloroindolen-3-yl)-1,3-cyclobutadienediylium-1,3-diolate
(13) 2,4-bis-(2-methyl-5-methoxyindolen-3-yl)-1,3-cyclobutadienediylium-1,3-diolate
(14) 2,4-bis-(1,3,3-trimethyl-5-chloroindolen-2-yl)-1,3-cyclobutadienediylium-1,3-diolate
(15) 2,4-bis-(p-diethylaminophenyl)-1,3-cyclobutadienediylium-1,3-diolate

What is claimed is:

1. A photoreceptor for use in an electrophotographic imaging process having a double charging sequence, comprising:

(a) a substrate;

(b) a photosensitive layer consisting essentially of a noncharge-transporting binder material and a charge-generating, charge-transporting squaric acid methine dye selected from the group consisting of compounds of formula I:

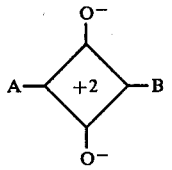

wherein A and B are independently,

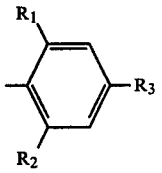

wherein $R_1$, $R_2$, and $R_3$ are independently H, OH, alkyl of 1 to 6 carbon atoms, or $NR_4R_5$, wherein $R_4$ and $R_5$ are independently alkyl of 1 to 6 carbon atoms;

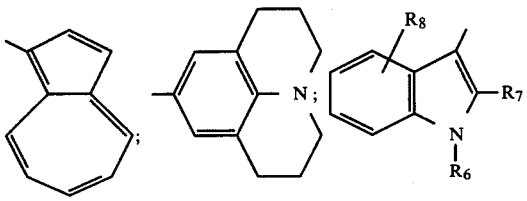

wherein $R_6$ and $R_7$ are independently alkyl of 1 to 6 carbon atoms, and $R_8$ is independently H, $OR_9$ or halogen, wherein $R_9$ is alkyl of 1 to 6 carbon atoms;

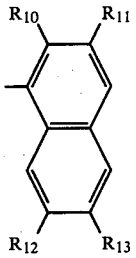

wherein $R_{10}$, $R_{11}$, $R_{12}$ and $R_{13}$ are independently H, OH or alkyl of 1 to 6 carbon atoms;

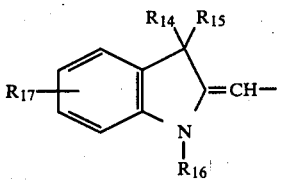

wherein $R_{14}$, $R_{15}$, and $R_{16}$ are independently alkyl of 1 to 6 carbon atoms, and $R_{17}$ is independently H, $OR_{18}$, or halogen, wherein $R_{18}$ is alkyl of 1 to 6 carbon atoms; or

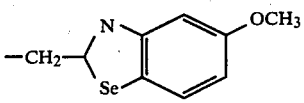

wherein said binder material is capable of supporting and storing charge throughout said photosensitive layer and wherein the ratio of said dye to said binder material is in the range from about 1:1 to about 1:40; and (c) an insulating layer.

2. A photoreceptor according to claim 1 wherein A and B are independently

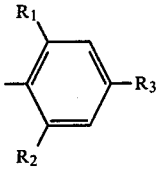

3. A photoreceptor according to claim 2 wherein $R_1$ is methyl, $R_2$ is hydrogen, and $R_3$ is dimethylamino, and A and B are the same.

4. A photoreceptor according to claim 1 wherein said insulating layer comprises a material selected from the group consisting of polyester, polycarbonate, polyacetate, polystyrene, polyfluoroethylene, polyethylene, polypropylene, polyvinyl chloride, polyvinylidene chloride, polyurethane, epoxy resin and melamine resin.

5. A photoreceptor according to claim 1 wherein said insulating layer comprises a polyester.

6. An electrophotographic imaging process having a double charging sequence, comprising the steps of:

(a) subjecting a photoreceptor to first electrostatic charges of one polarity, said photoreceptor comprising:

a substrate; a photosensitive layer consisting essentially of a noncharge-transporting binder material and a charge-generating, charge-transporting squaric acid methine dye selected from the group consisting of compounds of formula I:

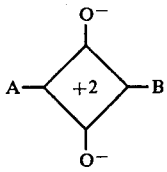

wherein A and B are independently,

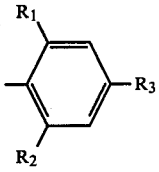

wherein $R_1$, $R_2$, and $R_3$ are independently H, OH, alkyl of 1 to 6 carbon atoms, or $NR_4R_5$, wherein $R_4$ and $R_5$ are independently alkyl of 1 to 6 carbon atoms;

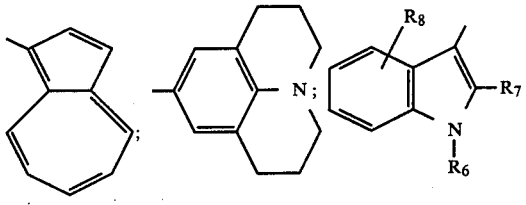

wherein $R_6$ and $R_7$ are independently alkyl of 1 to 6 carbon atoms, and $R_8$ is independently H, $OR_9$ or halogen, wherein $R_9$ is alkyl of 1 to 6 carbon atoms;

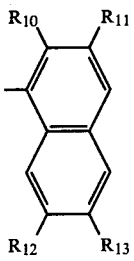

wherein $R_{10}$, $R_{11}$, $R_{12}$ and $R_{13}$ are independently H, OH or alkyl of 1 to 6 carbon atoms;

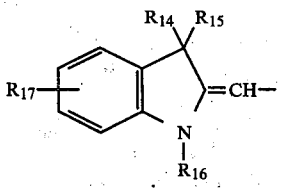

wherein $R_{14}$, $R_{15}$, and $R_{16}$ are independently alkyl of 1 to 6 carbon atoms, and $R_{17}$ is independently H, $OR_{18}$, or halogen, wherein $R_{18}$ is alkyl of 1 to 6 carbon atoms; or

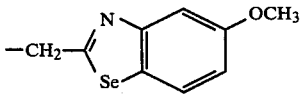

wherein said binder material is capable of supporting and storing charge throughout said photosensitive layer and wherein the ratio of said dye to said binder material is in the range from about 1:1 to about 1:40; and an insulating layer;

(b) subjecting said photoreceptor to second electrostatic charges of polarity opposite the polarity of said first electrostatic charges;

(c) simultaneously exposing said photoreceptor to an image-wise pattern of activating electromagnetic radiation; and (d) exposing said photoreceptor to a uniform amount of activating electromagnetic radiation to form an electrostatic latent image on the surface of said insulating layer.

7. An electrophotographic imaging process having a double charging sequence, comprising the steps of:

(a) subjecting a photoreceptor to first electrostatic charges of one polarity, said photoreceptor comprising:

a substrate; a photosensitive layer consisting essentially of a noncharge-transporting binder material and a charge-generating, charge-transporting squaric acid methine dye selected from the group consisting of compounds of formula I:

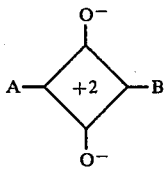

wherein A and B are independently,

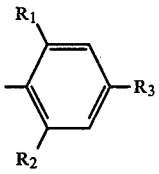

wherein $R_1$, $R_2$, and $R_3$, are independently H, OH, alkyl of 1 to 6 carbon atoms, or $NR_4R_5$, wherein $R_4$ and $R_5$ are independently alkyl of 1 to 6 carbon atoms;

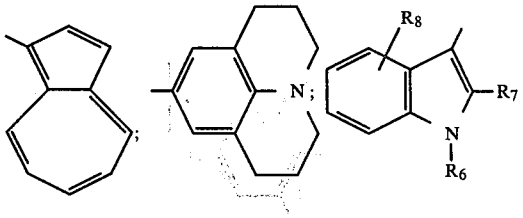

wherein $R_6$ and $R_7$ are independently alkyl of 1 to 6 carbon atoms, and $R_8$ is independently H, $OR_9$ or halogen, wherein $R_9$ is alkyl of 1 to 6 carbon atoms;

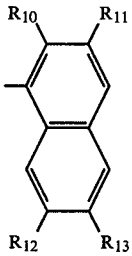

wherein $R_{10}$, $R_{11}$, $R_{12}$ and $R_{13}$ are independently H, OH or alkyl of 1 to 6 carbon atoms;

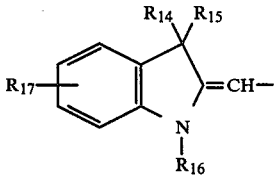

wherein $R_{14}$, $R_{15}$, and $R_{16}$ are independently alkyl of 1 to 6 carbon atoms, and $R_{17}$ is independently H, $OR_{18}$, or halogen, wherein $R_{18}$ is alkyl of 1 to 6 carbon atoms; or

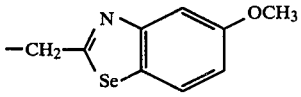

wherein said binder material is capable of supporting and storing charge throughout said photosensitive layer and wherein the ratio of said dye to said binder material is in the range from about 1:1 to about 1:40; and an insulating layer;

(b) subjecting said photoreceptor to A.C. electrostatic charges;

(c) simultaneously exposing said photoreceptor to an image-wise pattern of activating electromagnetic radiation; and (d) exposing said photoreceptor to a uniform amount of activating electromagnetic radiation to form an electrostatic latent image on the surface of said insulating layer.

8. An electrophotographic imaging process according to claim 6 or 7 wherein A and B are independently

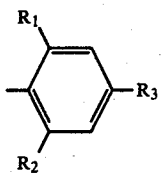

9. An electrophotographic imaging process according to claim 8 wherein $R_1$ is methyl, $R_2$ is hydrogen and $R_3$ dimethylamino, and A and B are the same.

10. An electrophotographic imaging process according to claim 6 or 7 wherein said insulating layer comprises a material selected from the group consisting of polyester, polycarbonate, polyacetate, polystyrene, polyfluoroethylene, polyethylene, polypropylene, polyvinyl chloride, polyvinylidene chloride, polyurethane, epoxy resin and melamine resin.

11. An electrophotographic imaging process according to claim 6 or 7 wherein said insulating layer comprises polyester.

* * * * *